United States Patent [19]

Schinner

[11] 3,965,225

[45] June 22, 1976

[54] SPACER-TURBULATOR

[75] Inventor: Edward N. Schinner, Silver Spring, Md.

[73] Assignee: Baltimore Aircoil Company, Inc., Jessup, Md.

[22] Filed: Mar. 11, 1974

[21] Appl. No.: 448,802

[52] U.S. Cl. ..... 261/79 A; 261/112; 261/DIG. 11

[51] Int. Cl.[2] ..... B01F 3/04

[58] Field of Search..... 261/111, 112, DIG. 11, 261/79 A, 95, 96, 101, 102; 161/44, 48, 49, 149; 165/166

[56] References Cited

UNITED STATES PATENTS

| | | | |
|---|---|---|---|
| 2,356,653 | 8/1944 | Cox | 261/111 |
| 2,610,835 | 9/1952 | Hytte | 261/112 X |
| 3,150,211 | 9/1964 | Murray et al. | 261/112 |
| 3,235,234 | 2/1966 | Beaudoin | 261/95 X |
| 3,313,533 | 4/1967 | Powers | 261/112 X |
| 3,469,626 | 9/1969 | Wright et al. | 261/112 X |
| 3,540,702 | 11/1970 | Uyama | 261/112 |
| 3,733,063 | 5/1973 | Loetel et al. | 261/112 |
| 3,739,556 | 6/1973 | Waters | 261/112 X |
| 3,804,389 | 4/1974 | Engalitcheff, Jr. et al. | 261/111 |

*Primary Examiner*—Tim R. Miles
*Assistant Examiner*—Richard L. Chiesa
*Attorney, Agent, or Firm*—Michael C. Sudol, Jr.; J. Jerome Behan

[57] ABSTRACT

This invention relates to a spacer-turbulator for use in separating corrugated type fill sheets of a cross-flow cooling tower and for imparting turbulence to the air flowing through said fill in said cross flow cooling tower.

5 Claims, 7 Drawing Figures

SPACER-TURBULATOR

BACKGROUND OF THE INVENTION

This invention relates to a spacer-turbulator for use in cross-flow induced draft cooling towers. Generally, the type of cooling tower on which this invention is used is a cross flow induced type cooling tower shown by FIG. 1. In this tower, air is induced into two sides of the tower 1 and 2 by means of a horizontally mounted type propeller fan 3. The air passes generally over inlet louvers 4; between surface wet deck sheets shown generally by 5 and then between mist eliminators 6 at which time it turns 90° to the generally vertical direction and passes through the fan 3 and ultimately discharges from the tower. Mounted directly above the surface sheets on both sides of the tower are hot water basins 7. The hot water emerging from the particular use to which the cooled water is put (generally an air conditioning unit, condenser or industrial process) flows into the basin and then is distributed uniformly over the surface by means of orifice-nozzle devices. The water then falls vertically over and between the surface sheets 5. The air rush towards the center of the tower tends to impart to the water a horizontal velocity component. The effect is that water falls approximately parallel to the miter angle of the surface bundle 5 with respect to a vertical line. The water falling generally vertical, while the air travelling generally horizontal, creates a cross flow heat transfer condition. The cooled water then falls into a collecting sump 8 from which it is pumped to recycle through the system.

The induced draft cross flow cooling tower shown in FIG. 1 has inherent difficulties associated with it from an efficient surface design standpoint when compared to forced draft counterflow towers. Since the air flow is induced, and not forced, it tends to be much more uniform and free from natural turbulence. Generally, the more turbulence there is, the better the air-water contact surface thereby increasing heat transfer efficiency. Also, because of the cross-flow, the length of time contact between the air and water is lower than with a counterflow tower along with lower corresponding relative velocities.

Applicant's spacer-turbulator when used in conjunction with corrugated type fill in a cross flow cooling tower has solved most of the problems resulting from lack of air turbulence and short air-water contact time.

SUMMARY OF THE INVENTION

The invention relates to a spacer-turbulator for use in a cross flow cooling tower. The spacer-turbulator acts jointly as a spacer to hold apart the corrugated type fill pieces and also to create turbulence in the air flow, the advantage of which has been previously discussed. Applicant has determined that generally corrugated type fill sheets as shown in FIGS. 2 and 3 stacked vertically and stacked apart by the spacer-turbulator of applicant's invention are excellent from a net water drop time standpoint. Hence, it is an object of this invention to slow down the velocity of water fall (i.e., to increase water suspension time) thereby increasing the air-water contact time and to create turbulence in a cross flow cooling tower without restricting static pressures.

The lack of turbulence was solved by applicant's invention herein namely the surface sheet spacer-turbulator. The surface turbulator is shown generally by the drawings attached, namely FIGS. 2–7. Briefly, these figures relate to apparatus as follows.

Figure 3:
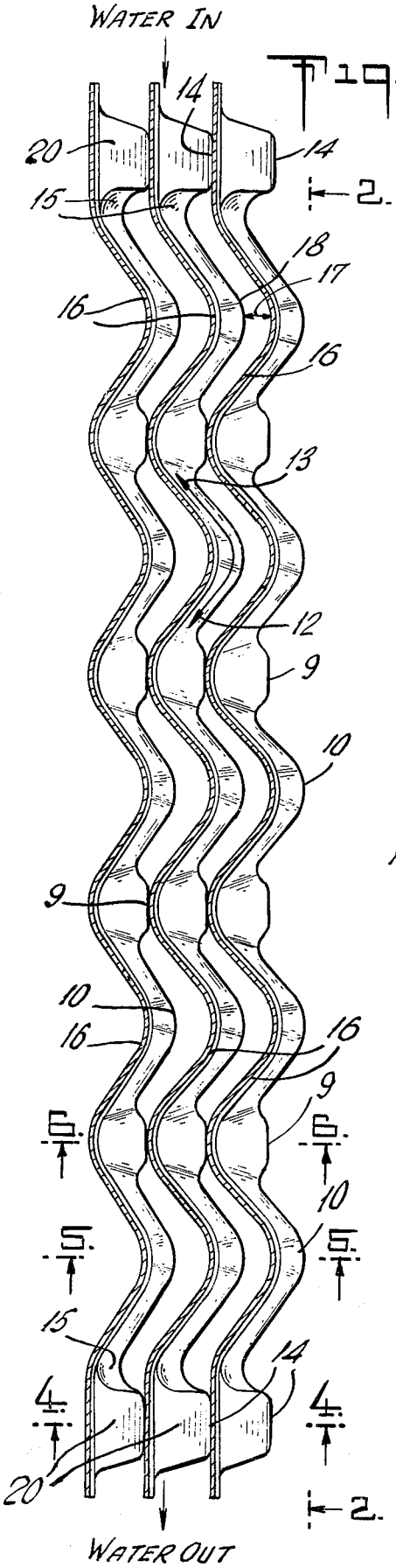
FIG. 3 is a transverse section taken on the lines 3—3 of FIG. 2 with the spacer-turbulator in position between each fill sheet. The water to be cooled flows between the fill sheets as indicated in FIG. 3 while the air flow is directly into the paper.
Figure 5:
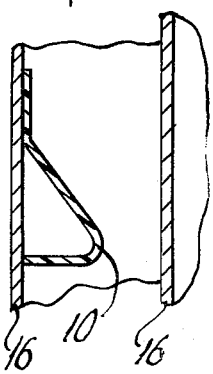
Figure 6:
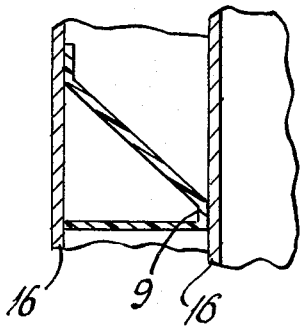

FIGS. 5 and 6 are similar views taken along lines 5—5 and 6—6 of FIG. 3.

Figure 7:
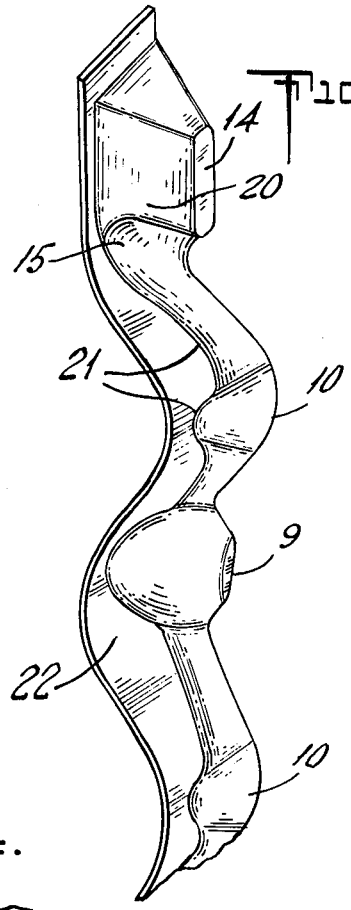
Figure 4:
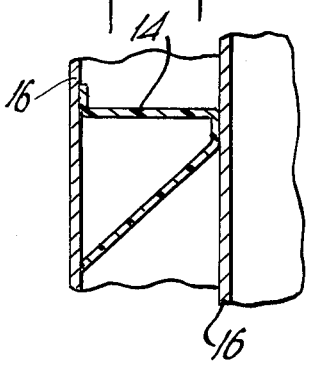
FIG. 4 is a section view of the spacer-turbulator and corrugated type fill sheets at line 4—4 of FIG. 3.

FIG. 7 is a fragmentary perspective of an end portion of a spacer-turbulator shown in FIG. 3.

The spacer-turbulator as shown in FIGS. 2–7 consist of a series of mounds (9 and 10) having a peak (10) and crest (9) at each corrugation or wave length in the corrugated type fill. The mounds 9 and 10 can be thought of as one-half of a smooth topped mountain or as a rounded top half cone with the base of the mountain or half cone starting at the air entrance side of the turbulator 21 and reaching its full height at the exit side of the turbulator. The crests 9 are part of mounds of a height equal to a surface sheet spacing requirement with the base of the mound communicating with a concave portion of the fill sheet while the top of the crest 9 rests against the concave portion of the next adjoining fill piece (see FIG. 3). The top of each crest 9 can be flattened slightly to make better contact with the next adjoining or adjacent fill sheet. The peaks 10 on the other hand are part of mounds approximately one-half as high.

Each peak 10 communicates at its base with the convex portion of the fill sheet. Also each peak 10 communicates with means extending in opposite directions toward each crest 9. These means are actually the surface area shown in FIG. 3 as stretching from 12 to 13. These means or surfaces are generally beveled or slanted in the direction of air flow (see FIG. 7). Thus, these means stretch from one concave portion 12 of the corrugated fill (also the base of crest 9) to the other concave portion 13 of the corrugated fill (also the base of another crest 9). The crests 9 and peaks 10 and the slanted or beveled means extending from opposite sides of each (shown as line 12–13) cause the air to rotate as it passes over them while forcing the air to diverge vertically as it travels generally horizontally. This is typically shown by the wavy lines in FIG. 2. The expansion and rotation is sufficient in turbulence to greatly improve heat transfer efficiency. The water film on the fill sheets is scrubbed by this rotation action and the water falling between the sheets is caught up by the air motion with intimate air water contact as a result. The divergence or fanning out of this air has been found to be so great that some air particles entering at one peak or crest area exit two to three peaks or crests higher or lower generally about 20 to 30 inches downstream. The rotation of the air is created naturally by the shape of the mounds 9 and 10 so static losses are minimized.

Figure 1:
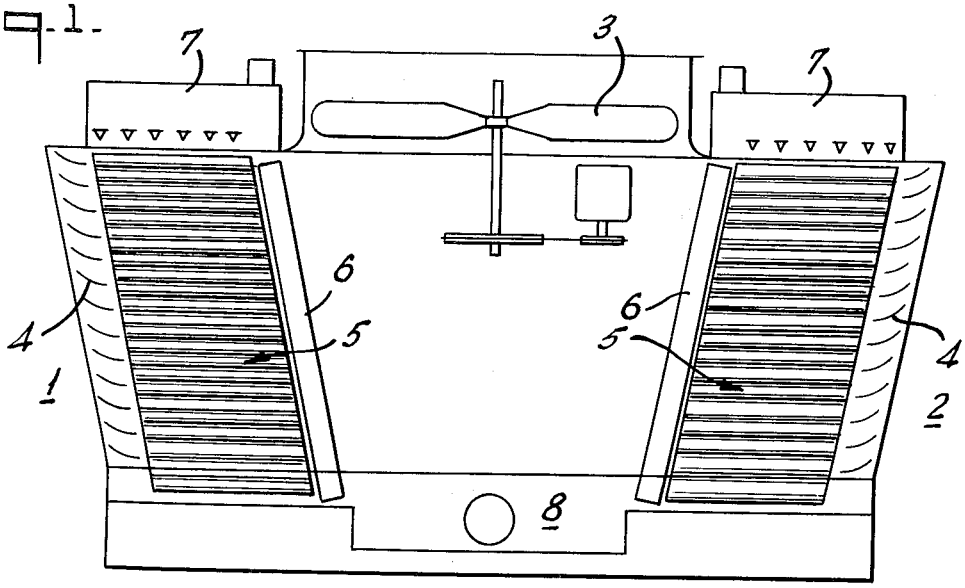
FIG. 1 is a schematic diagram of a typical cross flow induced draft cooling tower.
Figure 2:
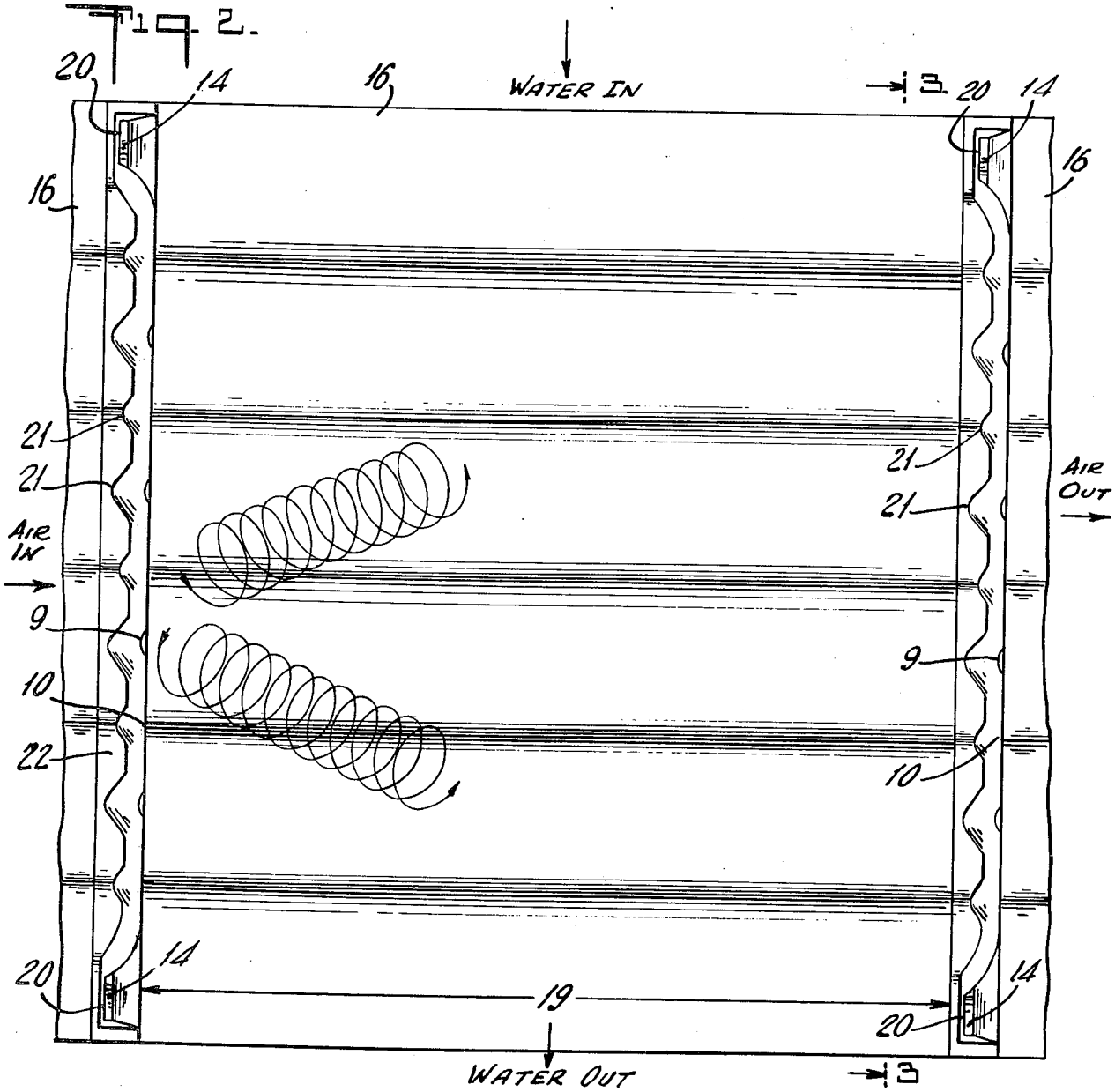
FIG. 2 is a side view of the corrugated type fill units of a typical cross flow cooling tower (5 in FIG. 1) with the spacer-turbulators therein taken on the lines 2—2 of FIG. 3.

In order to reach optimum conditions for the particular cross flow cooling tower shown in FIG. 1, the spacer-turbulators FIG. 7 were placed at approximately 10 inches horizontal intervals (dimension 19) along the fill sheets as shown in FIG. 2.

On each spacer-turbulator are two edge portions 14 which assist in holding each sheet apart from the other at the edge. These edge portions are merely projections having a flat face 20 with the inner part of each projection 15 being shaped as a smooth curved shape extending from the flat face 20 to a peak so as to give initial turbulence to the air in at the very edge of each sheet piece.

Applicant has made the spacer-turbulator (FIG. 7) from molded plastic but as anyone skilled in the art can appreciate, they can be molded or shaped from many materials. Applicant has attached the spacer-turbulators to the fill sheets by staples along the flat base portion 22 of the spacer-turbulator. However, the spacer-turbulators do not have to be considered individually from the fill sheets since one can appreciate that the surface sheets 16 and the spacer-turbulators of this invention could be molded as one piece.

Generally, the air space shown as 17 in FIG. 3 being bounded by a corrugated sheet 16 and the top edge of the peak 18 and which boundaries are generally parallel is about ¼ – ¾ inch. That is to say, a ¼ – ¾ inch wavelike portion of air space results between each fill sheet 16 and the top edge of a peak 18 or 10 of the spacer-turbulator. The distance between the top and base of a crest 9 is about ½ to 1½ inches which means that the sheets 16 themselves are held apart from ½ to 1½ inches.

There has thus been outlined rather broadly the more important features of the invention in order that the detailed description which preceded may be better understood, and in order that the present contribution to the art may be better appreciated. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

What is claimed is:

1. A spacer-turbulator portion of cooling tower corrugated fill sheets for separating said sheets and imparting corkscrew turbulence to air passing between said sheets which comprises:

a. raised mound means at the downstream portion of the spacer-turbulator for maintaining each fill sheet apart from an adjoining sheet, said mound means contacting the fill sheet at the base of a concave portion of the fill sheet and contacting the adjoining fill sheet at the base of its concave portion, said means being in repeating units; and b. raised means between each of the raised mound means extending from the apex of a convex portion of a fill sheet outward and in opposite directions toward each concave portion of the same fill sheet, said raised means defining with the adjoining fill sheet an air space.

2. A spacer-turbulator according to claim 1 wherein the raised mound means contacts the adjacent fill sheet only at the mound's apex which is at the concave portion of the adjoining fill sheet and the base of said mound contacts the fill sheet at its own concave portion.

3. A spacer-turbulator according to claim 1 wherein the raised means between each of the raised mound means extends from the apex of a convex portion of a fill sheet outward and in opposite directions so that said means communicates with the base of each mound means of part a) said raised means between each of the raised mound means defining an air space with the convex portion of the adjoining fill sheet.

4. A spacer-turbulator of claim 3 wherein there is mound means at the apex of each convex portion of a fill sheet, said mound means being an integral portion of the raised means between each of the raised mound means.

5. A spacer-turbulator of claim 3 wherein the means between each of the raised mound means is beveled and slanted in the direction of air flow.

* * * * *